US006435143B2

(12) United States Patent
Hollis

(10) Patent No.: US 6,435,143 B2
(45) Date of Patent: Aug. 20, 2002

(54) THREE-WAY SOLENOID VALVE FOR ACTUATING FLOW CONTROL VALVES IN A TEMPERATURE CONTROL SYSTEM

(76) Inventor: Thomas J. Hollis, 5 Roxbury Dr., Medford, NJ (US) 08055

( * ) Notice: Subject to any disclaimer, the term of this patent is extended or adjusted under 35 U.S.C. 154(b) by 0 days.

(21) Appl. No.: 09/792,899

(22) Filed: Feb. 26, 2001

Related U.S. Application Data

(60) Provisional application No. 60/186,120, filed on Mar. 1, 2000.

(51) Int. Cl.[7] ..... F01P 7/14
(52) U.S. Cl. ..... 123/41.1
(58) Field of Search ..... 123/41.1, 41.08; 137/625.65

(56) References Cited

U.S. PATENT DOCUMENTS 3,951,166 A * 4/1976 Whitener ..... 137/625.65
4,582,294 A * 4/1986 Fargo ..... 137/625.65
5,638,775 A * 6/1997 Hollis ..... 123/41.08

* cited by examiner

*Primary Examiner*—Marguerite McMahon
*Assistant Examiner*—Hyder Ali
(74) *Attorney, Agent, or Firm*—Drinker Biddle & Reath LLP

(57) ABSTRACT

A pressurization system for controlling actuation of flow control valves in a temperature control system is disclosed. The pressurization system includes a housing mounted to an internal combustion engine. A three-way solenoid valve is mounted to the housing and is adapted to control flow of pressurized fluid into and out of an electronic engine temperature control valve for controlling flow of temperature control fluid. The fluid flow out of the solenoid valve is channeled either along an external line to the electronic engine temperature valve or through internal channels in the engine to an oil reservoir.

11 Claims, 6 Drawing Sheets

THREE-WAY SOLENOID VALVE FOR ACTUATING FLOW CONTROL VALVES IN A TEMPERATURE CONTROL SYSTEM

RELATED APPLICATION

This application is related to and claims priority from provisional application Ser. No. 60/186,120, filed Mar. 1, 2000.

FIELD OF THE INVENTION

This invention relates to a system for controlling flow of temperature control fluid in a temperature control system and, more particularly, to a three-way solenoid valve in an injection system for actuating flow control valves to control temperature control fluid flow.

BACKGROUND OF THE INVENTION

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is started, the coolant rarely becomes hot enough to boil. Thus, the coolant does not need to flow through the radiator. Nor is it desirable to dissipate the heat energy in the coolant in such environments since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, coolant systems employ a thermostat. The thermostat operates as a one-way valve, blocking or allowing flow to the radiator. Most prior art coolant systems employ wax pellet type or bimetallic coil type thermostats. These thermostats are self-contained devices which open and close according to precalibrated temperature values.

Practical design constraints limit the ability oft he coolant system to adapt to a wide range of operating environments. For example, the heat removing capacity is limited by the size of the radiator and the volume and speed of coolant flow. The state of the self-contained prior art wax pellet type or bimetallic coil type thermostats is typically controlled only by coolant temperature.

The goal of all engine cooling systems is to maintain the internal engine temperature as close as possible to a predetermined optimum value. Since engine coolant temperature generally tracks internal engine temperature, the prior art approach to controlling internal engine temperature control is to control engine coolant temperature. Many problems arise from this approach. For example, sudden load increases on an engine may cause the internal engine temperature to significantly exceed the optimum value before the coolant temperature reflects this fact. If the thermostat is in the closed state just before the sudden load increase, the extra delay in opening will prolong the period of time in which the engine is unnecessarily overheated.

Another problem occurs during engine start-up or warm-up. During this period of time, the coolant temperature rises more rapidly than the internal engine temperature. Since the thermostat is actuated by coolant temperature, it often opens before the internal engine temperature has reached its optimum value, thereby causing coolant in the water jacket to prematurely cool the engine. Still other scenarios exist where the engine coolant temperature cannot be sufficiently regulated to cause the desired internal engine temperature.

When the internal engine temperature is not maintained at an optimum value, the engine oil will also not be at the optimum temperature. Engine oil life is largely dependent upon wear conditions. Engine oil life is significantly shortened if an engine is run either too cold or too hot. As noted above, a cold running engine will have less complete combustion in the engine combustion chamber and will build up sludge more rapidly than a hot running engine. The sludge contaminates the oil. A hot running engine will prematurely break down the oil. Thus, more frequent oil changes are needed when the internal engine temperature is not consistently maintained at its optimum value.

Prior art cooling systems also do not account for the fact that the optimum oil temperature varies with ambient air temperature. As the ambient air temperature declines, the internal engine components lose heat more rapidly to the environment and there is an increased cooling effect on the internal engine components from induction air. To counter these effects and thus maintain the internal engine components at the optimum operating temperature, the engine oil should be hotter in cold ambient air temperatures than in hot ambient air temperatures. Current prior art cooling systems cannot account for this difference because the cooling system is responsive only to coolant temperature. A solution to the problems associated with prior are cooling systems is disclosed in U.S. Pat. Nos. 5,467,745, 5,669,335, 5,507,251 and 5,657,722 which all disclose an improved temperature control system for controlling flow of temperature control fluid (e.g., coolant) in an internal combustion engine. These systems utilize an electronically controlled valve, (e.g., hydraulic, pneumatic, solenoid, stepper motor or thermostatic valve). The valve is controlled according to selected data in order to achieve optimum heating and cooling of the engine.

In one embodiment disclosed in those patents, hydraulic fluid is channeled through two solenoids for opening and closing a hydraulic valve. Referring to FIG. 1, a valve V is shown mounted to an internal combustion engine E. The valve V has two solenoids S1, S2 mounted on its housing, which control hydraulic fluid flow into and out of the housing. FIG. 2 is a partial cross-sectional view of one embodiment of the valve V showing fluid channels between the solenoids, S1, S2 and the valve V. One solenoid S1 controls flow of pressurized oil along an external fluid line F1 from an oil pan OP to the valve V. The second solenoid S2 controls flow from the valve back to the oil pan OP from the valve V along a second external fluid line F2.

In U.S. Pat. No. 5,638,775, an alternate hydraulic fluid injection system was disclosed wherein the solenoids were mounted to a housing which is separate from the valve. The system again utilizes two separate solenoids and external fluid lines between the valve and the oil pan.

Testing has shown that in very cold temperature conditions, fluid in external fluid lines can thicken and become difficult to pump. Also, the use of two separate solenoids is not the most cost effective way of controlling fluid flow to a valve.

A need, therefore, exists for an improved solenoid system for controlling hydraulic fluid flow to an engine temperature control valve.

SUMMARY OF THE INVENTION

A solenoid assembly is disclosed for controlling flow of hydraulic fluid from an engine to an electronic engine temperature control valve. The solenoid assembly includes a housing for mounting to an engine. The housing includes first and second fluid channels that are formed in the housing and spaced apart from one another. The first fluid channel is adapted to communicate with a high pressure internal supply flow path formed in the engine. The second fluid channel adapted to communicate with a low pressure internal return flow path formed in the engine and is in fluid communication with a hydraulic fluid reservoir. The first and second fluid channels communicate with an internal cavity formed in the housing.

A fluid outlet port is formed on the housing and is designed to be connected to an external fluid line for supplying fluid to an electronic engine temperature control valve.

A three-way solenoid valve is removably engaged with the housing. The solenoid valve has a shaft that includes at least three ports. A first port which is located within the housing and in fluid communication with the first fluid channel. A second port is located within the housing and is in fluid communication with the second fluid channel. A third port is located within the housing and is in fluid communication with the fluid outlet port. The solenoid valve is adapted to receive electrical signals for controlling flow through the ports.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with one or more preferred embodiments, it will be understood that it is not intended to limit the invention to any particular embodiment. On the contrary, it is intended to cover all alternatives, modifications and equivalents as may be included within the spirit and scope of the invention as defined by the appended claims.

For the sake of brevity, when discussing the flow of temperature control fluid in the engine, it should be understood that the fluid flows through water jackets formed within the engine. For example, when discussing the flow of temperature control fluid through an engine block, it should be understood that the fluid is flowing through a water jacket of the engine block.

Figure 1:
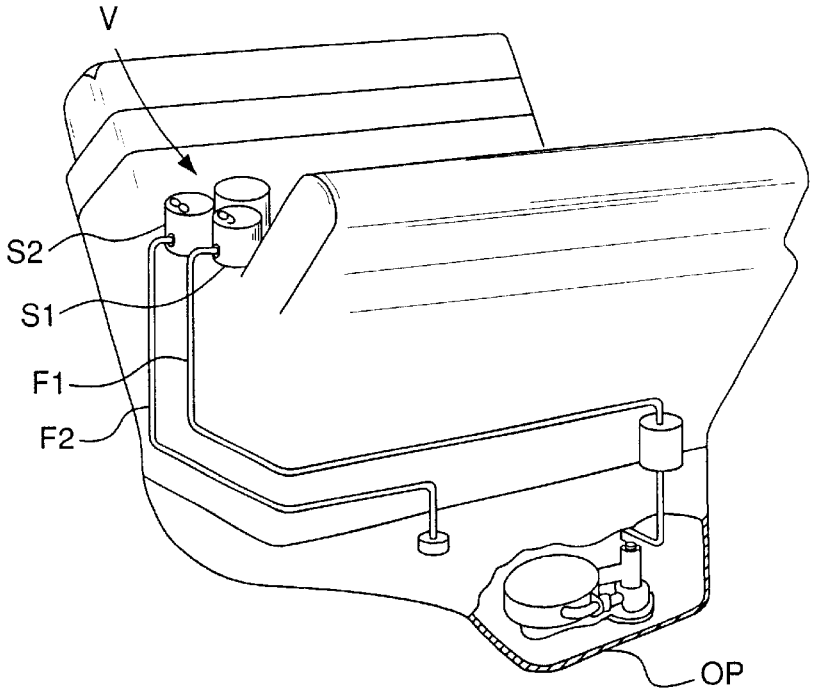
FIG. 1 PRIOR ART
FIG. 1 is schematic isometric view of an internal combustion engine incorporating a hydraulic fluid injection system according to the prior art.
Figure 2:
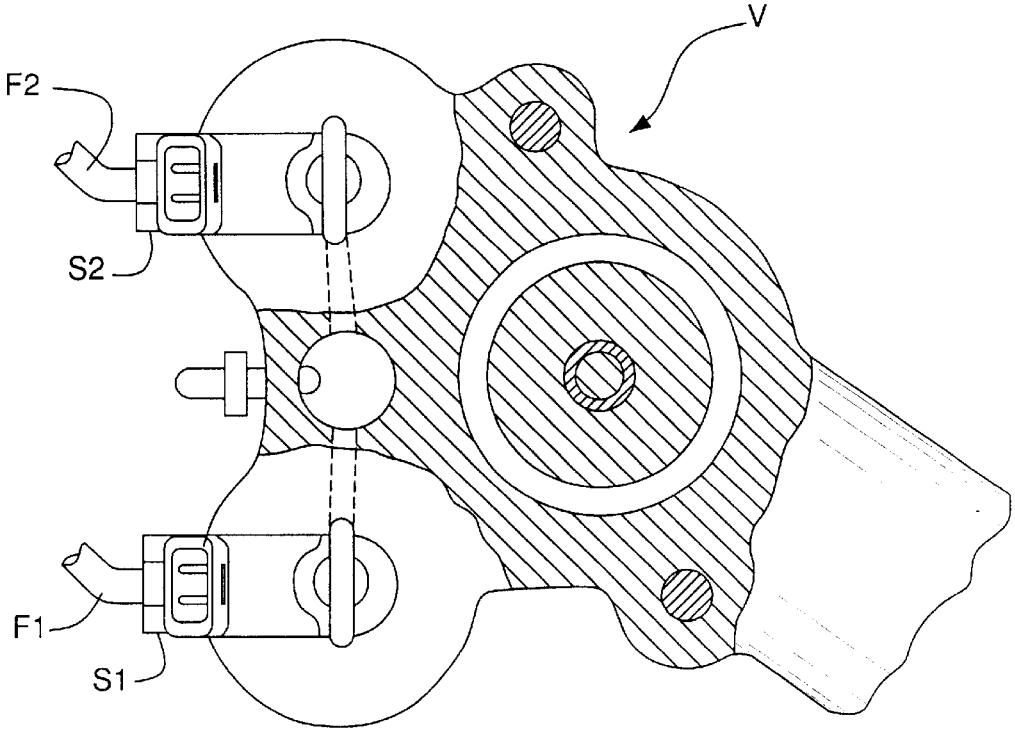
FIG. 2 PRIOR ART
FIG. 2 is a partial sectional view of the hydraulic fluid injection system in FIG. 1.
Figure 3:
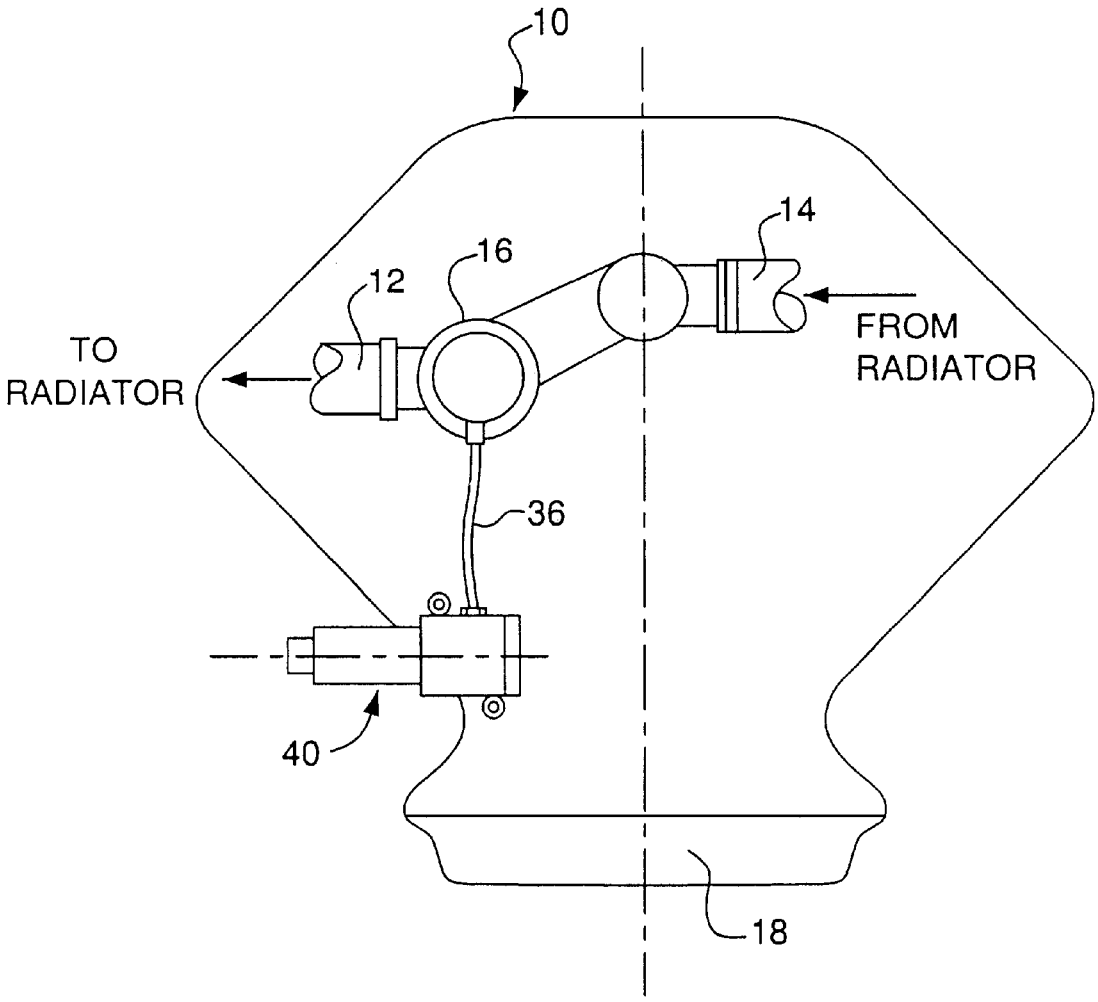
FIG. 3 is a schematic view of an internal combustion engine incorporating a solenoid assembly according to the present invention.

FIG. 3 illustrates a schematic front view of an internal combustion engine generally designated with numeral 10. The internal combustion engine 10 includes a radiator (not shown) mounted adjacent to an engine block/head combination (referred to herein as "the engine"). The radiator is fluidly connected to the engine through two hoses. An inlet hose 12 channels temperature control fluid from the engine to an inlet on the radiator in a conventional manner. An outlet hose 14 channels temperature control fluid from the radiator to the engine.

An electronic engine temperature control valve 16 (hereinafter "EETC valve") is shown mounted to the internal combustion engine, but could also be separate from it. The EETC valve 16 is connected to either the inlet hose 12 or the outlet hose 14 and controls flow of temperature control fluid through the hose. In the illustrated embodiment, the EETC valve 16 is mounted to the inlet hose 12 and controls flow of temperature control fluid from the engine 10 to the radiator. Various embodiments of the EETC valve 16 are described in detail in U.S. Pat. Nos. 5,467,745, 5,669,335, 5,507,251 and 5,657,722, all of which are incorporated herein by reference in their entirety. A further embodiment of the EETC valve is disclosed in co-pending patent application Ser. No. 09/436,267, entitled "Pressure Opening Fail Safe Valve for an Electronic Temperature Control System", filed Nov. 8, 1999 (Attorney Docket No. 8668-36). This application is also incorporated herein by reference in its entirety. The operation of the EETC valve and the electronic engine temperature control system are described in detail in the above-referenced patents and application. No further discussion is, therefore needed.

Attached to the lower portion oft he engine 10 is an oil pan 18 which provides a reservoir for hydraulic engine lubricating oil. An oil pump (not shown) is located within the oil pan 18 or attached to the engine block and operates to direct hydraulic lubricating oil to the various members being driven within the engine.

Figure 4:
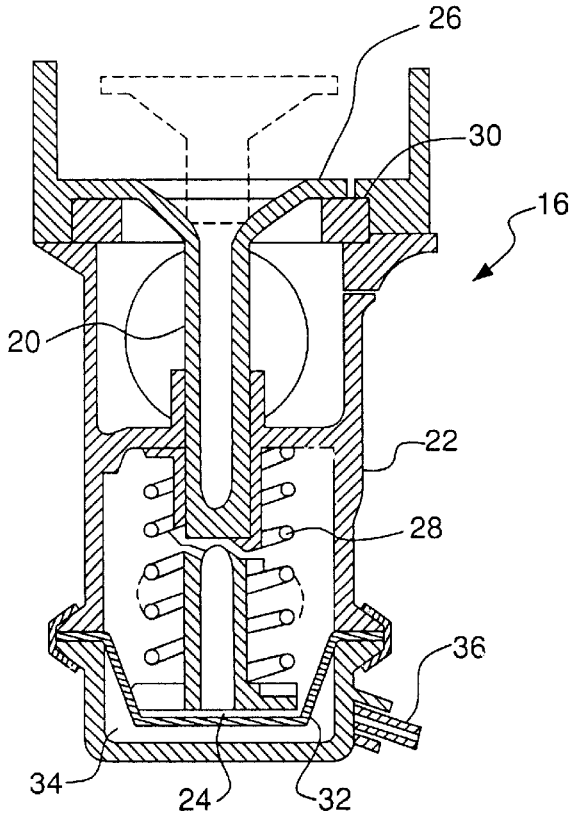
FIG. 4 is a cross-sectional view of one embodiment of an electronic engine temperature control valve for use with the present invention.

A cross-sectional view of one embodiment of the EETC valve 16 for use with the present invention is shown in FIG. 4. The EETC valve 16 controls flow to/or from the engine by movement of a slidable piston 20 within a valve housing 22. The piston 20 includes a pressure head 24 and a sealing head 26. A spring 28 is disposed about the piston 20 and biases the piston in a prescribed direction. In the illustrated embodiment, the EETC valve 16 is a pressure opening valve. The spring biases the piston 20 such that the sealing head 24 sits against a seat 30 when the valve is not pressurized. A diaphragm 32 is preferably located between the pressure head 24 and an end of the housing 22. The diaphragm 32 is attached to the housing so as to form a sealed chamber 34 between the housing 22 and the pressure head 24.

A fluid line 36 is connected to the housing 22 and is in fluid communication with the chamber 34. The fluid line 36 is operative for directing a pressurized medium into and out of the chamber 34 for increasing and decreasing, respectively, the pressure within the chamber. The increase in pressure is designed to displace the diaphragm 32 and pressure head 24, thereby translating the piston 20 within the housing 22. The translation of the piston caused by an increase in pressure results in compression of the spring 28. Concomitantly with the compression of the spring 28, the sealing head 26 unseats (shown in phantom).

Figure 5:
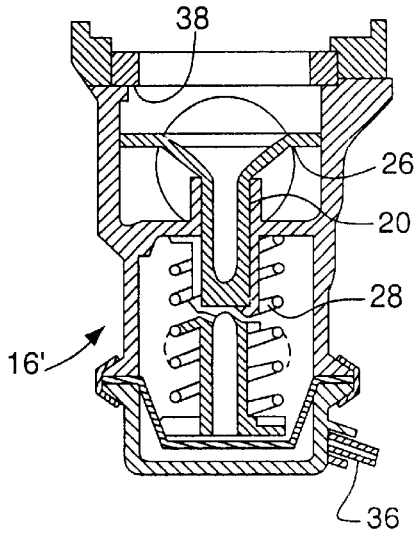
FIG. 5 is a cross-sectional view of an alternate embodiment of an electronic engine temperature control valve for use with the present invention.

FIG. 5 illustrates an alternate EETC valve 16' which is a pressure closing valve (i.e., pressure is supplied to the valve to close it). The components of this embodiment are similar to the components discussed above with respect to FIG. 4. However, the sealing head 26 seats against an internal sealing surface 38 when the valve is pressurized. The spring 28 biases the sealing head 26 away for the sealing surface 38. Pressurized fluid is supplied along the fluid line 36 to the chamber 34 to translate the piston 20 (and, thus, the sealing head 26) toward the sealing surface 38.

Figure 6:
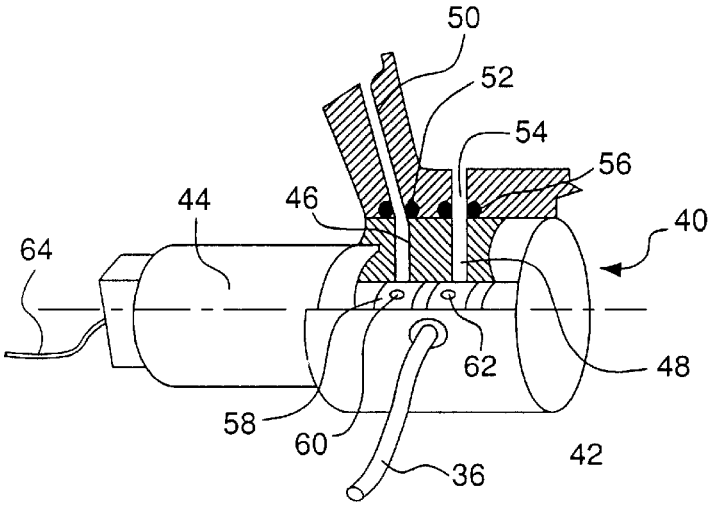
FIG. 6 is a partial cross-sectional view of a solenoid assembly according to the present invention.
Figure 9:
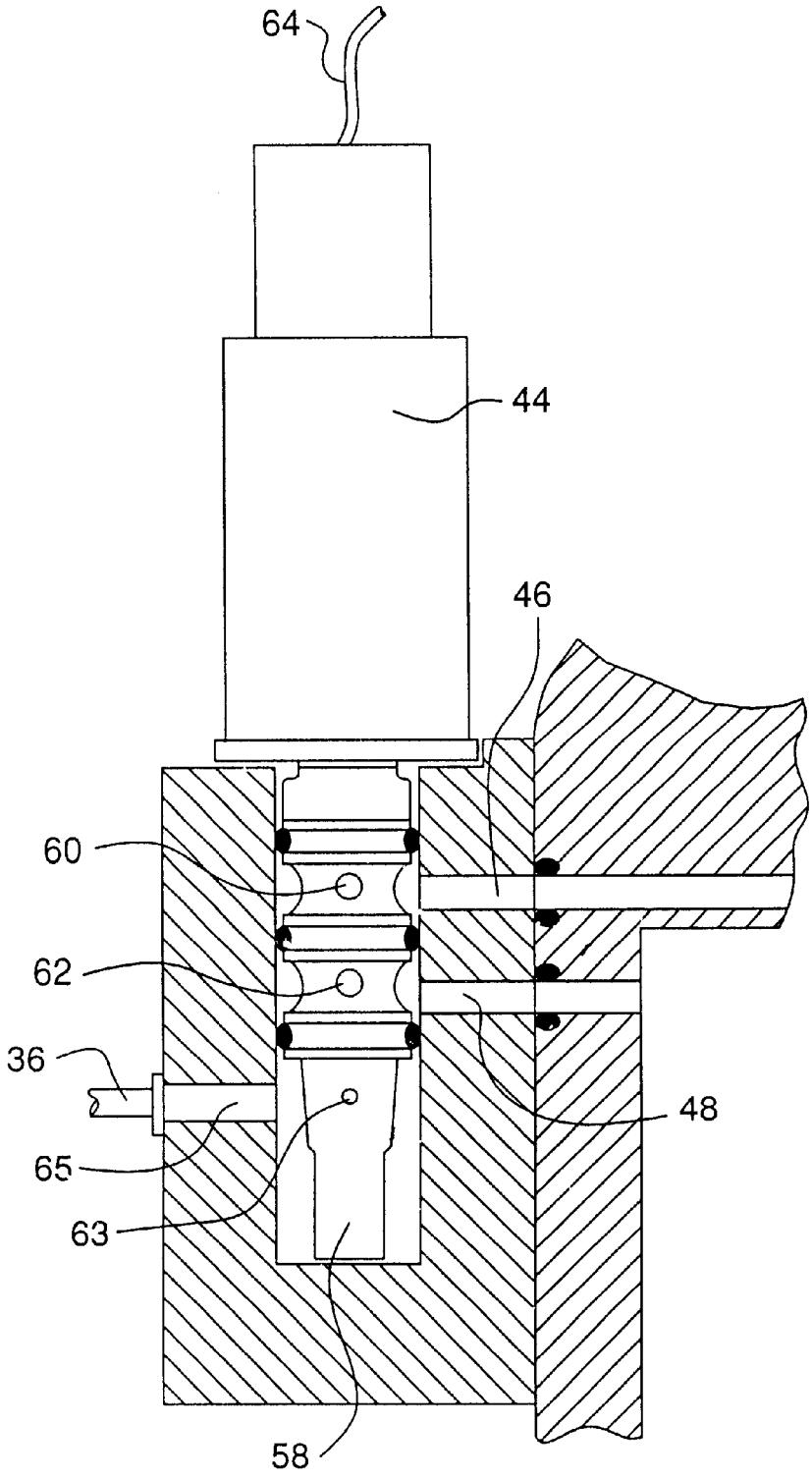
FIG. 9 is a cross-sectional view of the housing illustrating the location of the solenoid ports with respect to the fluid channels.

Referring to FIGS. 6 and 9, a three-way solenoid assembly 40 is shown for controlling flow of pressurized fluid along the fluid line 26. The solenoid assembly 40 includes a housing 42 which is attached to the engine, preferably on the block adjacent to the oil gallery, as shown schematically in FIG. 3. A solenoid valve 44 is attached to the housing 42 in any conventional way known to those skilled in the art. Preferably the solenoid valve 44 is bolted or threaded into the housing 42 so that the valve 44 can be readily removed if needed. The housing 42 includes a first fluid channel 46 and second fluid channel 48. The fluid channels 46, 48 are spaced apart from one another and communicate with an interior cavity within the housing 42.

When attached to the engine, the first fluid channel 46 is in fluid communication with a first internal flow path 50 formed in the engine wall. The first internal flow path 50 preferably connects to a source of pressurized oil, such as the oil pump in the oil pan or, more preferably, the oil gallery within the engine. An O-ring seal 52 prevents leakage of hydraulic fluid between the first fluid channel 46 and the first internal flow path 50.

The second fluid channel 48 is in fluid communication with a second internal flow path 54 formed in the engine wall. The second internal flow path 54 preferably extends through the wall to a drainage location, such as the oil pan. Again, an O-ring seal 56 is used to prevent leakage of hydraulic fluid between the second fluid channel 48 and the second internal flow path 54.

The solenoid valve 44 includes a shaft 58 with first, second and third fluid ports 60, 62, 63. The first and second ports 60, 62 communicate with the first and second fluid channels 46, 48, respectively. The third fluid port 63 communicates with a fluid outlet port 65 which extends through the housing and communicates with the fluid line 36. The solenoid valve 44 controls flow from the first and second ports 60, 62 to the third port 63 and, thus, to the fluid line 36. An electrical line 64 connects the solenoid valve 44 with a control unit (not shown). Electrical command signals are sent along the electrical line 64 to control the valving of the ports such that high pressure fluid is either supplied from the solenoid assembly 40 along the fluid line 36 to the EETC valve 14, or returned to the solenoid assembly 40 from the EETC valve 16 along the fluid line 36.

The solenoid valve 44 includes two operating positions. In its first operating position, the valve 44 permits flow to be channeled from the first port 60 through the port housing 58 to the third port 63. An internally mounted valve member (not shown) inhibits flow through the second port 62 In the second operating position, the internal valve member inhibits flow into or out of the first port 60, but permits fluid to flow from the third port 63 through the port housing 58 and out of the second port 62.

Although not shown, the solenoid valve 44 includes an internal spring which is configured to bias the valve into its second operating position so that, when no electrical current is sent to the valve 44, fluid flow is permitted to flow from fluid line 36 to the second fluid channel 48.

Figure 10:
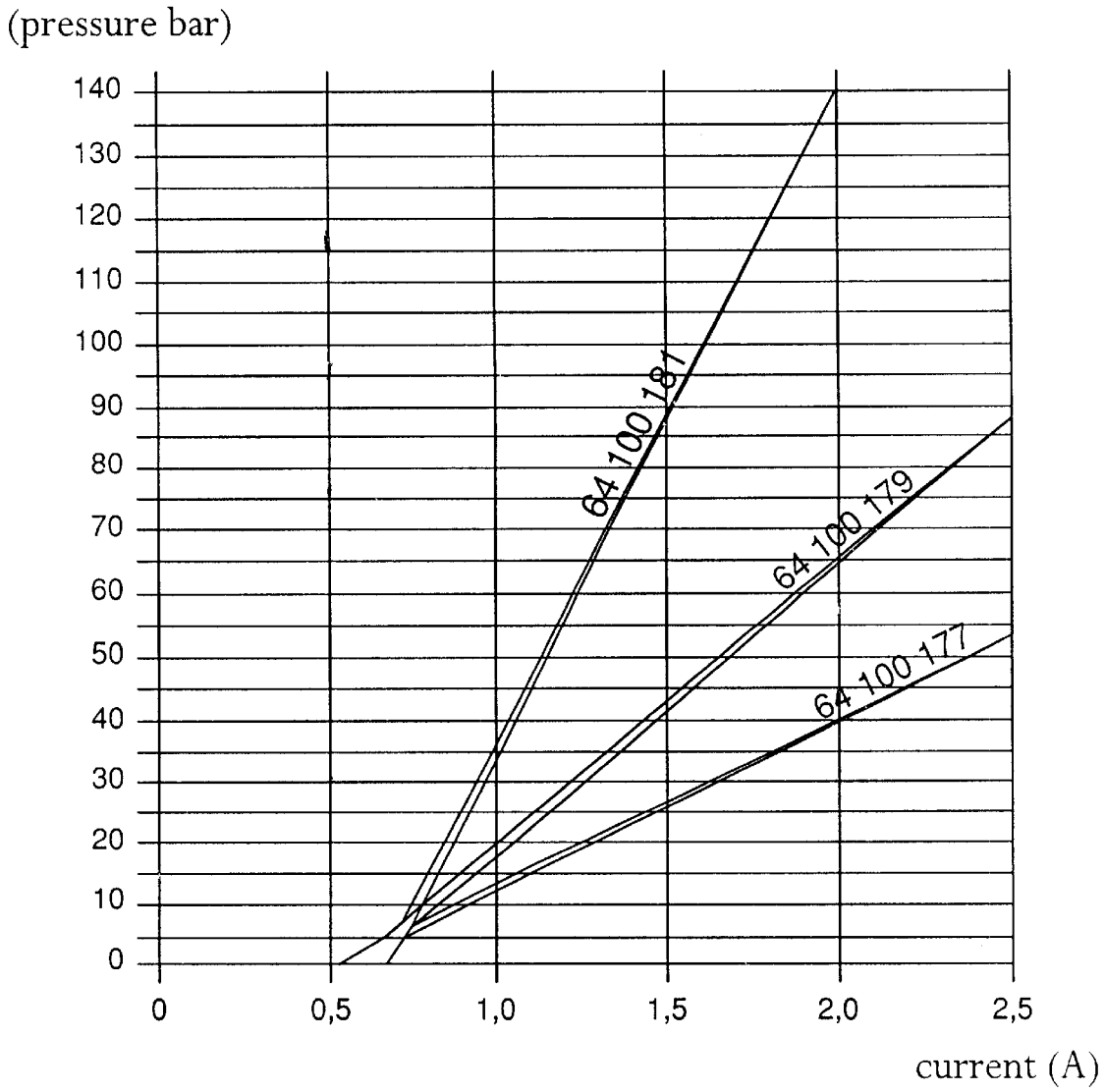
FIG. 10 is a chart illustrating the variation in pressure depending on the applied current for one preferred valve.

One suitable 3-way solenoid valve for use in the present invention is manufactured by Hydraulik Ring, a division of Siemens Automotive Group. The valve is referred to as a "Directly Controlled 3/2 Flow Proportional Valve". A "Proportional Pressure Reducing Valve" sold by Hydraulik Ring could also be used in the present invention. These valves are capable of handling the operating temperatures and pressures that exist in the current EETC system (i.e., from −40° C. to 130° C.). This latter valve requires the application of a current of approximately 1.5 amps or more to open. However, because of the design configuration of the valve, once the valve is open (i.e., placed in its first operating position or state, the applied current can be reduced to approximately 0.5 amps and still produce sufficient pressure (i.e., greater than 2 bar) to maintain the valve in its first position. As such, power consumption is reduced using the preferred proportional valve. (FIG. 10 is a chart illustrating the variation in pressure for the preferred valve based on the applied current.)

Figure 7:
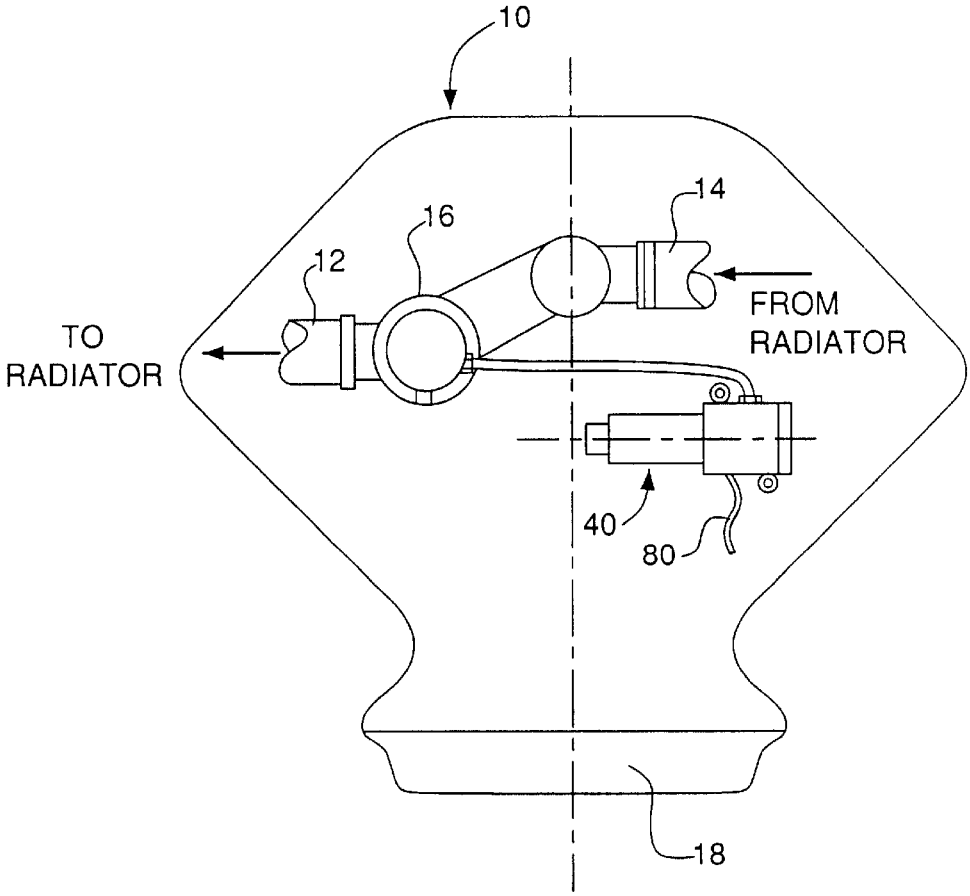
FIG. 7 is a schematic view of an internal combustion engine incorporating an alternate configuration of the solenoid assembly according to the present invention.
Figure 8:
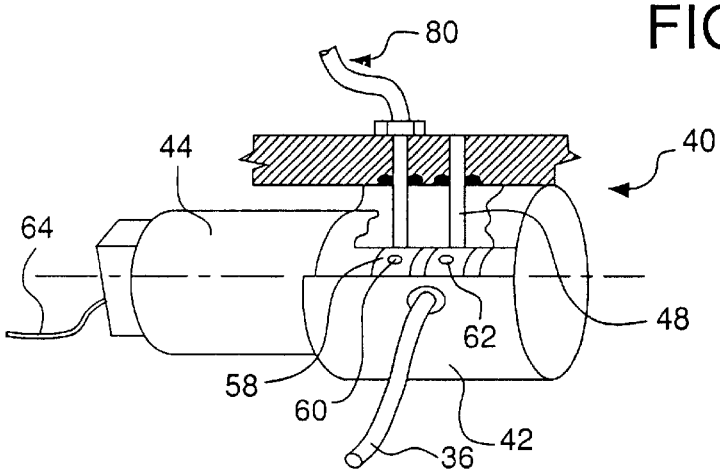
FIG. 8 is a partial cross-sectional view of an alternate solenoid assembly shown in FIG. 7.

An alternate embodiment oft he invention is shown in FIGS. 7 and 8. In this embodiment, the first fluid path 50 is not connected to a channel formed in the wall but, instead, connected to the engine via a flow line 80.

It is also anticipated, although not preferred, that the solenoid assembly could be mounted directly to the EETC valve.

The present hydraulic fluid injection system provides a simple and light weight design for supplying pressurized fluid to an EETC valve. By mounting the solenoid directly to the engine, the number of external supply lines are greatly reduced. Also, by using a 3-way solenoid valve, only one supply line is needed to supply the pressurized fluid to the EETC valve, thereby reducing the number of components in the system and minimizing leakage locations.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

What is claimed is:

1. A solenoid assembly for controlling flow of hydraulic fluid from an engine to an electronic engine temperature control valve, the solenoid assembly comprising:

a housing adapted to be mounted to an engine, the housing including first and second fluid channels formed in the housing and spaced axially apart from one another, the first fluid channel adapted to communicate with a high pressure hydraulic fluid source in the engine, the second fluid channel adapted to communicate with a hydraulic fluid return in the engine which is in fluid communication with a hydraulic fluid reservoir; the first and second fluid channels communicating with an internal cavity within the housing;

a fluid outlet port formed in the housing and adapted to be connected to an external fluid line; and a three-way solenoid valve, engaged with the housing, the solenoid valve having a port housing located within the cavity, the port housing having an outer wall located within the cavity and an interior, the port housing including a first port formed in the port housing and extending into the port housing from the outer wall, the first port being located at a position on the port housing so as to be in fluid communication with the first fluid channel, a second port formed in the port housing and extending into the port housing from the outer wall, the second port being located at a position on the port housing so as to be in fluid communication with the second fluid channel, and a third port formed in the port housing and extending into the port housing from the outer wall, the second port being located at a position on the port housing so as to be in fluid communication with the fluid outlet port, the third port being in fluid communication with the first and second ports through the interior of the port housing, the solenoid valve adapted to receive electrical signals for controlling flow through the ports.

2. A solenoid assembly according to claim 1 wherein the cavity is centrally located within the housing and wherein the first and second fluid channels and the fluid outlet port extend substantially radially outwardly from the cavity.

3. A solenoid assembly according to claim 1 wherein the three-way solenoid valve includes at least two operating positions, the first position permitting hydraulic fluid flow into the first port and out of the third port; and the second position permitting hydraulic fluid flow into the third port and out of the second port.

4. A solenoid assembly according to claim 3 wherein the port housing has a longitudinal axis and wherein the ports are spaced axially along the longitudinal axis of the port housing; wherein the three-way solenoid valve further includes seals located between adjacent ports and spaced axially along the longitudinal axis of the port housing, the seals forming a fluid seal between the port housing and the housing so as to prevent the passage of hydraulic fluid between adjacent ports.

5. A solenoid assembly according to claim 4 wherein the housing is adapted to be mounted to an engine block.

6. A solenoid assembly according to claim 4 wherein the three-way solenoid is removably mounted to the housing.

7. A solenoid assembly for controlling flow of hydraulic fluid from an engine to an electronic engine temperature control valve, the solenoid assembly comprising:

a housing adapted to be mounted to an engine, the housing including a central cavity;

a first fluid channel formed in the housing and adapted to channel high pressure hydraulic fluid from the engine to the central cavity;

a second fluid channel formed in the housing and adapted to channel low pressure hydraulic fluid from the central cavity to the engine, the second fluid channel being spaced axially apart from the first fluid channel;

a fluid outlet port formed in the housing and extending outward from the central cavity, the fluid outlet port adapted to be connected to an external fluid line; and a three-way solenoid valve, removably attached to the housing, the three-way solenoid valve having a port housing disposed within the central cavity, the port housing having an outer wall located within the cavity and an interior, the port housing including a first port formed in the port housing and extending into the port housing from the outer wall, the first port being located at a position on the port housing so as to be in fluid communication with the first fluid channel, a second port formed in the port housing and extending into the port housing from the outer wall, the second port being located at a position on the port housing so as to be in fluid communication with the second fluid channel, and a third port formed in the port housing and extending into the port housing from the outer wall, the third port being located at a position on the port housing so as to be in fluid communication with the fluid outlet port, the third port being in fluid communication with the first and second ports through the interior of the port housing, the solenoid valve adapted to receive electrical signals for controlling flow through the ports.

8. A solenoid assembly according to claim 7 wherein the first and second fluid channels and the fluid outlet port extend substantially radially outwardly from the cavity.

9. A solenoid assembly according to claim 7 wherein the three-way solenoid valve includes at least two operating positions, the first position permitting hydraulic fluid flow into the first port and out of the third port; and the second position permitting hydraulic fluid flow into the third port and out of the second port.

10. A solenoid assembly according to claim 9 wherein the port housing has a longitudinal axis and wherein the ports are spaced axially along the longitudinal axis of the port housing; wherein the three-way solenoid valve further includes seals located between adjacent ports and spaced axially along the longitudinal axis of the port housing, the seals forming a fluid seal between the port housing and the housing so as to prevent the passage of hydraulic fluid between adjacent ports.

11. A solenoid assembly according to claim 10 wherein the housing is adapted to be mounted to an engine block.

* * * * *